US010624199B2

(12) United States Patent
Stubbers et al.

(10) Patent No.: US 10,624,199 B2
(45) Date of Patent: Apr. 14, 2020

(54) COMPACT SYSTEM FOR COUPLING RF POWER DIRECTLY INTO RF LINACS

(71) Applicant: Starfire Industries, LLC, Champaign, IL (US)

(72) Inventors: Robert A. Stubbers, Savoy, IL (US); Brian E. Jurczyk, Champaign, IL (US); Thomas J. Houlahan, Jr., Urbana, IL (US); James M. Potter, Los Alamos, NM (US)

(73) Assignee: Starfire Industries, LLC, Champaign, IL (US)

( * ) Notice: Subject to any disclaimer, the term of this patent is extended or adjusted under 35 U.S.C. 154(b) by 0 days.

(21) Appl. No.: 15/803,320

(22) Filed: Nov. 3, 2017

(65) Prior Publication Data

US 2018/0124910 A1 May 3, 2018

Related U.S. Application Data

(60) Provisional application No. 62/416,900, filed on Nov. 3, 2016.

(51) Int. Cl.

| | |
|---|---|
| ***H05H 7/02*** | (2006.01) |
| ***H05H 7/18*** | (2006.01) |
| ***H01J 3/02*** | (2006.01) |

(52) U.S. Cl.

CPC ..... *H05H 7/02* (2013.01); *H05H 7/18* (2013.01); *H01J 3/027* (2013.01); *H01J 3/028* (2013.01); *H05H 2007/025* (2013.01)

(58) Field of Classification Search

CPC ..... H05H 7/02; H05H 2007/02; H05H 2007/085; H05H 2007/087; H05H 2007/227; H05H 2007/025

See application file for complete search history.

(56) References Cited

U.S. PATENT DOCUMENTS 5,084,682 A * 1/1992 Swenson ..... H05H 7/02 315/5.41

5,962,995 A * 10/1999 Avnery ..... H01J 3/027 250/492.3

(Continued)

OTHER PUBLICATIONS

Peters, J., "Internal Versus External RF Coupling Into a Volume Source," *Proceedings of EPAC*, 1727-1729, Paris, France (2002).

(Continued)

*Primary Examiner* — Renan Luque

(74) *Attorney, Agent, or Firm* — Leydig, Voit & Mayer, Ltd.

(57) ABSTRACT

A system for injecting radio frequency (RF) pulses into an RF linear accelerator (RF LINAC) cavity is described. In accordance with the description an RF power amplifying element, typically a compact planar triode (CPT), is directly mounted to an outside of a hermetically sealed RF cavity. The direct mounting of the RF power amplifying element places the antenna—responsible for coupling power into the RF cavity—physically on the RF cavity side of a hermetic high-voltage (HV) break. The RF input, RF circuitry, biasing circuitry, and RF power amplifier are all outside of the vacuum cavity region. The direct mounting arrangement facilitates easy inspection and replacement of the RF power amplifier, the RF input and biasing circuitry. The direct mounting arrangement also mitigates the deleterious effects of multipactoring associated with placing the RF power amplifier and associated RF circuitry in the vacuum environment of the RF LINAC cavity.

25 Claims, 6 Drawing Sheets

(56) References Cited

U.S. PATENT DOCUMENTS

| | | | | |
|---|---|---|---|---|
| 6,407,492 | B1 * | 6/2002 | Avnery | H01J 3/027 250/492.3 |
| 6,653,803 | B1 * | 11/2003 | DiVergilio | H05H 7/02 250/492.21 |
| 7,242,158 | B2 | 7/2007 | Whitham et al. | |
| 8,179,047 | B2 * | 5/2012 | Espiau | H01J 65/044 315/248 |
| 8,779,697 | B2 | 7/2014 | Baurichter et al. | |
| 2003/0197572 | A1 * | 10/2003 | Ammar | H01P 5/103 333/26 |
| 2008/0218082 | A1 * | 9/2008 | Boy | H01T 1/20 313/631 |
| 2013/0093320 | A1 * | 4/2013 | Abs | H05H 7/02 315/5.18 |
| 2013/0113374 | A1 * | 5/2013 | Espiau | H01J 65/044 315/39 |
| 2015/0349499 | A1 * | 12/2015 | Lester | H01T 15/00 315/39 |

OTHER PUBLICATIONS

International Patent Application No. PCT/US2017/059968, International Search Report (dated Feb. 5, 2018).

* cited by examiner

COMPACT SYSTEM FOR COUPLING RF POWER DIRECTLY INTO RF LINACS

STATEMENT REGARDING FEDERALLY SPONSORED RESEARCH AND DEVELOPMENT

This work has been supported by the U.S. Defense Advanced Research Projects Agency (DARPA), under contract HR0011-15-C-0072. The views, opinions, and/or findings expressed are those of the authors and should not be interpreted as representing the official views or policies of the Department of Defense or the U.S. Government.

CROSS-REFERENCE TO RELATED APPLICATION

This application is a non-provisional of U.S. Provisional Application Ser. No. 62/416,900, filed Nov. 3, 2016, entitled "A COMPACT SYSTEM FOR COUPLING RF POWER DIRECTLY INTO RF LINACS," the contents of which are expressly incorporated herein by reference in their entirety, including any references therein.

TECHNICAL FIELD

The disclosure generally relates to injecting power into accelerator devices, and more particularly to relatively compact high-power radio frequency linear accelerator (RF LINAC) systems.

BACKGROUND OF THE INVENTION

High-power RF cavities, such as those found in an RF LINAC, require not only tremendous RF powers (on the order to 10's to 100's of kW and above), but also a vacuum environment to prevent arcing and sparking within the RF cavity due to the intense electric fields associated with such high powers. Typically, RF power is coupled into a high-power RF cavity via a waveguide and a hermetic RF window. This approach, while viable at high power LINAC applications, requires additional hardware, which increases the cost, size and complexity of compact high power RF LINAC systems.

An alternative approach to the one described above is to couple RF power directly into the RF cavity via an RF amplifier assembly mounted on, and with an output stage coupled directly to, the RF cavity. This approach is described in Swenson, U.S. Pat. No. 5,084,682. However, the inclusion of the entire vacuum tube (and its associated tuning elements) within the vacuum envelope has led to an inability to operate at high powers due to processes such as multipactoring. For this reason, as much as possible of the RF and biasing circuitry needs to be at atmospheric pressure. In addition to this constraint, problems arise in the structure described in Swenson due to high powers dissipated both in the antenna and in the anode of the vacuum tube if these structures are not actively cooled. Swenson's approach to mounting the RF amplifier in a high power RF LINAC is further complicated by a vacuum tube anode commonly being held at high voltage, which necessitates the careful selection of a coolant.

SUMMARY OF THE INVENTION

A system is provided for injecting radio frequency energy into an accelerator. In accordance with the illustrative examples, the system includes a vacuum chamber containing a cavity structure. The system further includes a power amplifier assembly directly coupled to the cavity structure. The power amplifier assembly includes: an RF power amplifier located, in operation, external and adjacent to the vacuum chamber, a socket interface that complementarily accepts the RF power amplifier, an electrically insulating break between the socket interface and the cavity structure, and an antenna located within the cavity structure, wherein the antenna is connected to the socket interface and electromagnetically coupled to the cavity structure.

The system further includes a power supply interface including: a biasing element to bias the power amplifier assembly, and an RF power source supplying a radio frequency energy to the power amplifier assembly for amplifying by the RF power amplifier and transmitting a resulting amplified RF power into the cavity structure.

Additional features and advantages of the invention will be made apparent from the following detailed description of illustrative examples that proceeds with reference to the accompanying figures.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE DRAWINGS

The detailed description of the figures that follows is not to be taken in a limiting sense, but is made merely for the purpose of describing the principles of the described embodiments.

A structural assembly and system are described that, in operation, inject RF power directly into an accelerator, such as a radio frequency quadrupole (RFQ) LINAC, while placing both the RF power amplifier itself as well as the RF input circuitry and the biasing circuitry outside of the vacuum environment occupied by the LINAC cavity. A critical aspect of this invention is that it allows for the use of the LINAC cavity itself as the output stage of the amplifier, removing any need for transmission lines between the final amplification stage and the LINAC cavity. The described structural assembly arrangement exhibits multiple advantageous features. The arrangement mitigates the deleterious effects of multipactoring associated with placing elements associated with the RF power amplifier in a vacuum environment. Moreover, the arrangement enables inspecting/replacing the RF power amplifier without breaking the vacuum seal of the RF LINAC cavity.

A low capacitance hermetic HV break is of particular importance to the functionality of the RF power amplifier arrangement described herein. The low capacitance characteristic of the hermetic HV break (described in detail herein below) ensures a sufficiently low capacitance between the RF power amplifier's output stage and the LINAC cavity. By way of an illustrative example, the hermetic HV break is a piece of alumina ceramic (or other suitable dielectric material) joined, for example by brazing or other suitable metallic material bonding technique, to copper (or other suitable conductive material) at both ends.

A further aspect of illustrative examples is that both the RF power amplifier's output stage and the antenna are placed at the same DC potential as the LINAC system. Additionally the illustrative examples provide a mechanism to directly and easily cool the amplifier and antenna elements via a flowing liquid (e.g. water) cooling loop. An illustrative example of this aspect of the invention would be to route the cooling loop through the antenna itself, mounted to the anode electrode at one end and ground at the other.

By way of an illustrative example, a system is described herein for injecting RF power directly into an RF LINAC (such as a radio frequency quadrupole (RFQ) accelerator), while placing both the RF power amplifier, the RF input circuitry, and the biasing circuitry outside of the vacuum environment occupied by the LINAC cavity. An illustrative example of such system is schematically depicted in FIG. 1.

Figure 1:
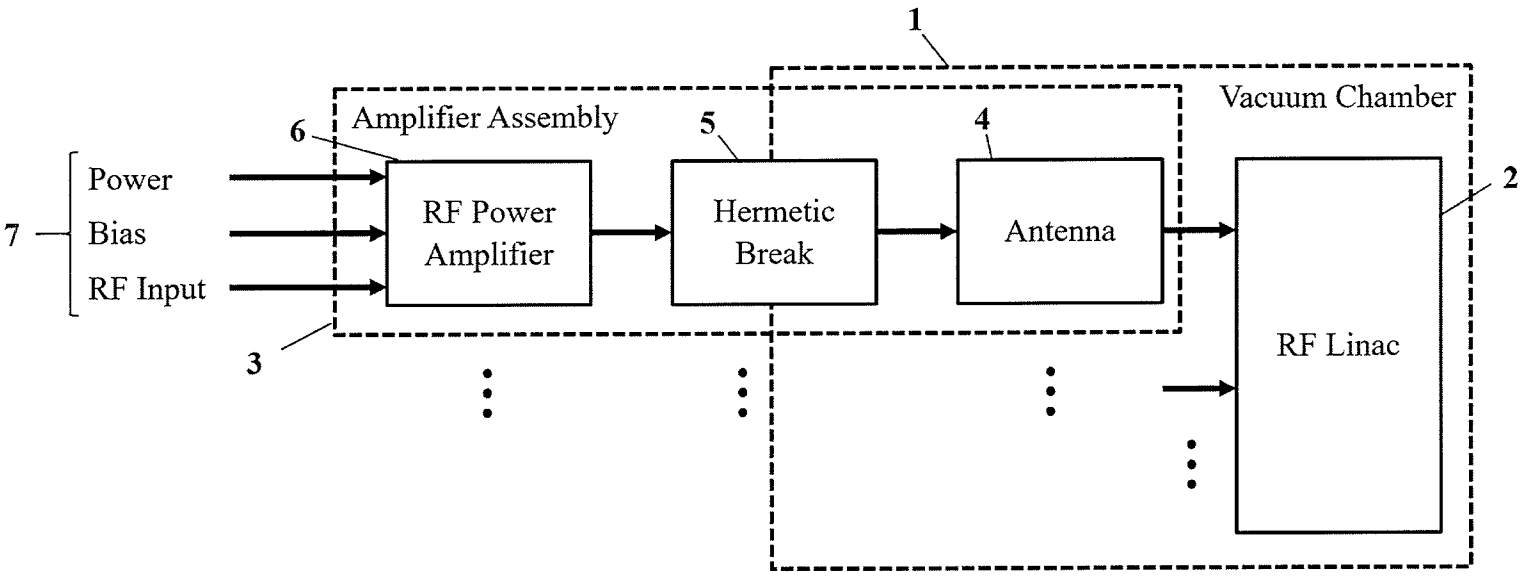
FIG. 1 is a schematic drawing of a system suitable for incorporating the features of the invention.

Turning to FIG. 1, the primary components of the illustratively depicted system include: a vacuum chamber 1 containing a cavity 2 (e.g. one or more LINAC cavities), one or more of a power amplifier assembly 3 (including an RF power amplifier 6, a hermetic break 5, and an antenna 4) directly coupled to the cavity 2 structure, an electronic circuit interface including a set of inputs 7. The set of inputs 7 of the electronic circuit interface are configured to provide power, bias voltages/currents, and sufficiently high-power radio frequency energy to the one or more of the power amplifier assembly 3. The received radio frequency energy is amplified by the one or more of the power amplifier assembly 3 for transmission into the cavity 2 structure.

By way of further explanation/definition, "directly coupled", as used above to describe the structural relationship between the power amplifier assembly 3 and the cavity 2, is defined as an electrical energy coupling relationship such that there is a negligible power transmission line between the power amplifier assembly 3 output interface and the cavity 2 structure. In the illustrative example, such direct coupling is achieved by the power amplifier assembly 3 having the hermetic break 5 barrier between the antenna 4 (which couples to the cavity 2 and is held at vacuum) and the RF power amplifier 6 (operating at atmospheric pressure).

Figure 2A:
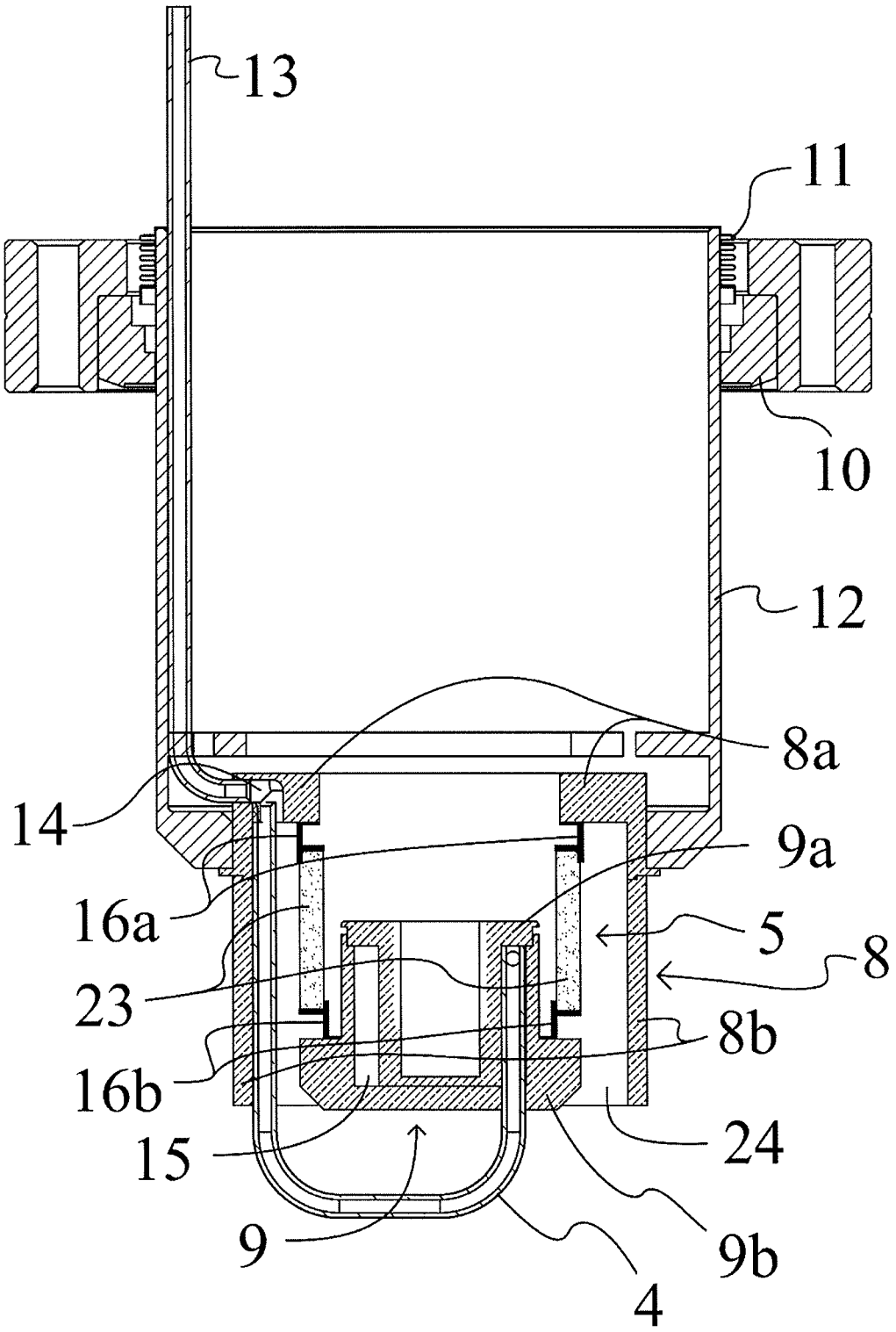
FIG. 2A depicts a cross-sectional view of a hermetic break sub-assembly element of the system schematically depicted in FIG. 1, including an RF antenna, socket interface, and vacuum flange termination.
Figure 2B:
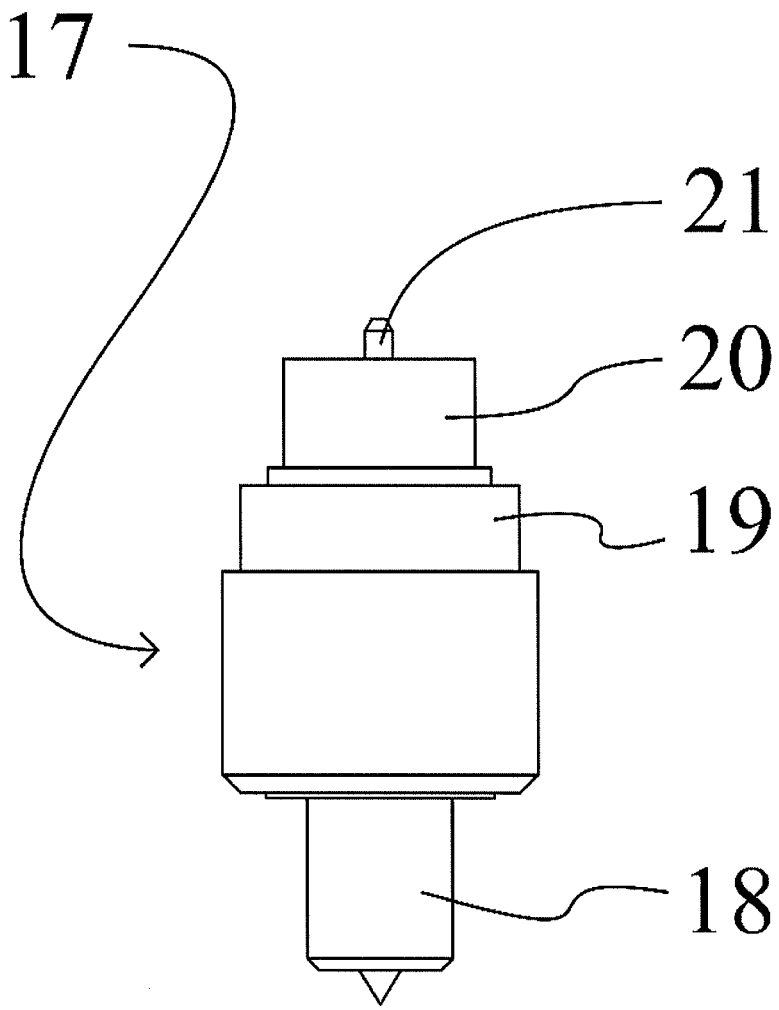
FIG. 2B depicts an illustrative RF power amplifier, which is, for example, a compact planar triode structure.
Figure 2C:
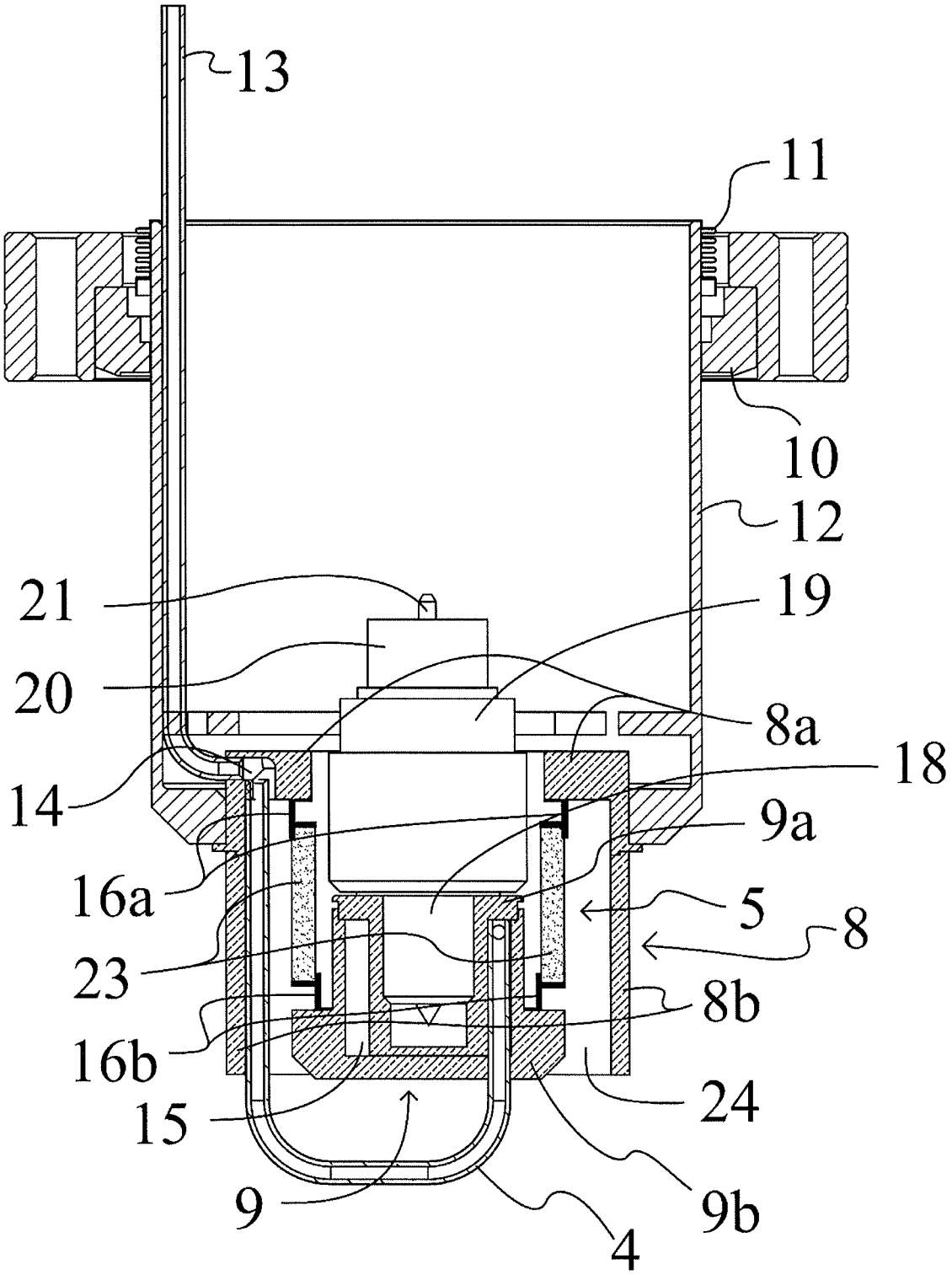
FIG. 2C depicts sub-assemblies from FIGS. 2A and 2B arranged as a power amplifier assembly for the RF LINAC system schematically depicted in FIG. 1.

By way of an illustrative example, FIG. 2C depicts a power amplifier assembly that comprises two sub-assemblies. Each of the two sub-assemblies is depicted, by way of further particular example, in FIGS. 2A and 2B. FIG. 2A depicts a sub-assembly including the hermetic break 5. Thereafter, FIG. 2B illustratively depicts, by way of example, an example of the RF power amplifier 6 sub-assembly, in the form of a compact planar triode sub-assembly 17.

Turning to FIG. 2A, the sub-assembly including the hermetic break 5 will now be described by way of a detailed example. By way of illustrative example, the hermetic break 5 is generally cylindrical. The hermetic break 5 includes a dielectric body 23 that is generally cylindrical in shape and made of, for example, a ceramic material. The hermetic break 5 also includes, at opposing ends, the first conductive material 16*a* and the second conductive material 16*b*. In the illustrative example, the first conductive material 16*a* and the second conductive material 16*b* are generally ring-shaped and occupy the ends of the generally cylindrically shaped dielectric body 23 of the hermetic break 5. The sub-assembly illustratively depicted in FIG. 2A also includes a socket interface 9 to which the output of the RF power amplifier 6 is connected. Turning briefly to FIG. 2B, a suitable structure, a compact planar triode (CPT) 17, for connecting the output of the RF power amplifier 6 to the hermetic break 5 is depicted. With continued reference to both FIGS. 2A and 2B, the CPT 17 is attached at an anode electrode 18 (also referred to as a plate electrode) to the socket interface 9 of the sub-assembly containing the hermetic break 5 structure.

With continued reference to FIG. 2A, the sub-assembly including the hermetic break 5 also includes a fixed potential electrode 8 to which the antenna 4 is connected. The fixed potential electrode 8, by way of example, is also generally cylindrically shaped. Thus, in the illustrative example, a generally cylindrical space 24 is formed between the fixed potential electrode 8 and the dielectric body 23 of the hermetic break 5. The antenna 4, which occupies an area within an approximate range of 0.1 $in^2$ to 5 $in^2$, is also connected to the socket interface 9 electrode. Due to high currents involved in operation of the illustrative LINAC system, the antenna 4, the socket interface 5, and the fixed potential electrode 8 are all made from, or at least coated with a sufficiently thick layer of, a high-conductivity material, such as copper. The term "sufficiently thick" here is defined as being equal to or greater than one skin depth at the intended operating frequency of the LINAC system. In conjunction with the cavity 2, the above-described conductive structures determine/establish an effective electrical impedance (Z1) observed from the output interface of the RF power amplifier 6.

Figure 4:
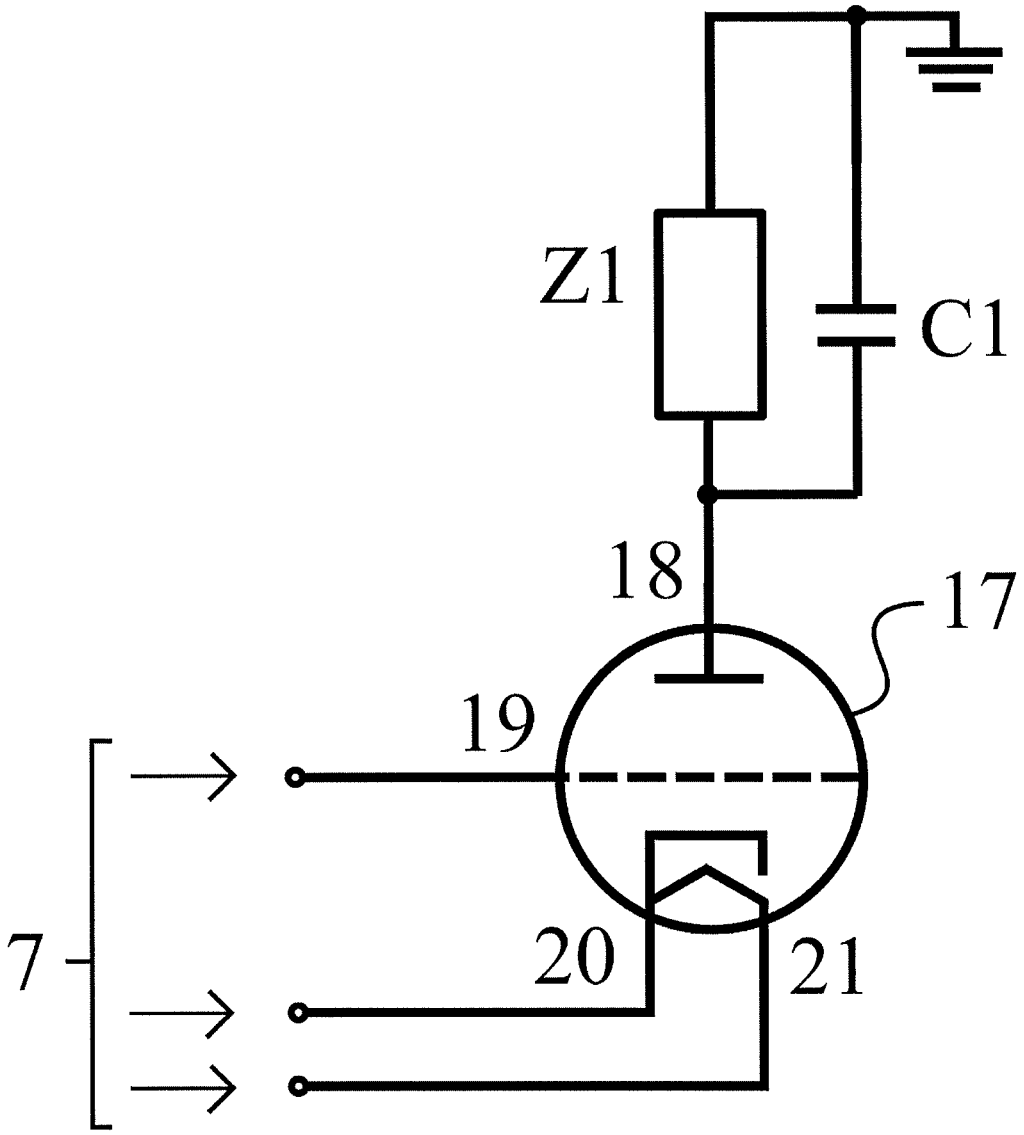
FIG. 4 schematically depicts an equivalent electrical circuit diagram/model for the power amplifier assembly, in operation, depicted, by way of example, in FIG. 2C.

With continued reference to FIG. 2A, the hermetic break 5 is physically connected, at the first conductive material 16*a* and the second conductive material 16*b* to the socket interface 9 (provided in the illustrative example as two physically joined pieces 9*a* and 9*b*) and the fixed potential electrode 8 (provided in the illustrative example as two physically joined pieces 8*a* and 8*b*). The electrically insulating ceramic material of the dielectric body 23 provides a high-voltage break point between the RF output of the RF power amplifier 6, received via the socket interface 9, and the fixed potential electrode 8. The hermetic break 5 also exhibits a characteristic of a sufficiently low interelectrode capacitance, which manifests electronically as a capacitive load C1 in parallel with the load Z1 provided by the combination of the antenna 4 and the cavity 2. The above-described electrical circuit characteristics of the hermetic break 5 are summarized in the effective electrical circuit model of the system schematically depicted in FIG. 4.

By way of further explanation/definition, a "sufficiently low" interelectrode capacitance is defined such that the inverse of the interelectrode capacitance is greater than or equal to the angular frequency of the RF input multiplied by the magnitude of the antenna impedance. In the illustrative example depicted in FIG. 2A, the hermetic break 5 high-voltage break characteristic is carried out by the first conductive material 16*a* and the second conductive material 16*b* being joined to the dielectric body 23 by two ceramic-to-metal seals (e.g. alumina-to-copper joints achieved via brazing or diffusion bonding), where each one of the two ceramic-to-metal seals is located at an end of the generally cylindrical dielectric body 23. The metal sides of each joint, which are formed respectively by the first conductive material 16*a* and the second conductive material 16*b*, have a mechanical stress-relieving structural characteristic/feature 16 to account for differences in coefficients of thermal expansion between the two dissimilar materials (metal and ceramic) of the hermetic break 5 and thereby facilitate reliable bonding. A variety of insulator break and hermetic sealing configurations are contemplated for signally coupling the RF amplifier output with the cavity structure and vacuum chamber. In a particular illustrative example, directly joining high-conductivity copper (16*a* and 16*b*) to the ceramic material (23) yields superior RF power transmission capability—compared to a traditional Kovar to ceramic braze process—avoiding a potentially difficult/challenging further step of subsequently coating exposed metal surfaces in a high-conductivity material, such as copper. While shown as a separate physical feature in FIG. 2A, it is noted that in other illustrative examples the first conductive material 16*a* may be an integral part of the fixed potential electrode 8 structure. Likewise, the second conductive material 16*b* may be an integral part of the socket interface 9 structure.

When the antenna 4 configuration is a loop antenna structure, as is the case in the example illustratively depicted in FIG. 2A, the antenna 4 may be constructed from hollow tubing though which coolant may be controllably passed to achieve desired temperature control of system components. A coolant input/output structure 13 is depicted in FIG. 2A. The coolant input/output structure 13 is connected to the antenna 4 (a hollow tube structure) via a set of two channels 14 that pass through the fixed potential electrode 8, into which the coolant input/output structure 13 and the antenna 4 tubes are inserted and then welded, brazed, epoxied or otherwise sealed. Further, a hollow cavity 15 within the socket interface 9 for coolant flow allows for more efficient cooling of the RF power amplifier 6.

In accordance with the illustrative example depicted in FIG. 2A, a ConFlat (CF) flange 10 may be used in conjunction with a bellows 11 to ensure that structural interfaces of the RF power amplifier assembly can be mated to the vacuum chamber while remaining tolerant to manufacturing errors in either the power amplifier assembly 3, the cavity 2, or the vacuum chamber 1 that would require the power amplifier assembly 3 to maintain some variability/adjustability in its positioning.

An alternative to the above approach is to make the vacuum seal permanent instead of demountable. This could, for example, be accomplished by replacing the CF flange 10 by a welded, brazed, or epoxied joint. The fixed potential electrode 8 and the bellows 11 are connected via a cylindrical housing 12, whose function is simply to provide a structurally sound vacuum barrier between where the power amplifier assembly 3 mates to the cavity 2 and mates to the vacuum chamber 1.

Regardless of any specific illustrative example, with the RF power amplifier 6 located on the air-side of the vacuum chamber 1, deleterious effects such as multipactoring and surface flashover can be minimized or even eliminated for the power conditions of a LINAC or other RF cavity structure. This is a significant improvement over the current state of the art. Power dissipation and cooling can further be managed external to the vacuum environment.

Further, with the illustrative examples, the RF power amplifier 6 of the illustrative RF power amplifier assembly, which may comprise several instances of the RF power amplifier 6, can be rapidly changed out for programmed maintenance, or at end of life, without venting the vacuum chamber 1. In the illustrative example depicted in FIG. 2C, this is done by removing the electronic interface through which inputs 7 are applied, and then removing the RF amplifying element 6, which is replaced before re-inserting the physical interface for the inputs 7. In the illustrative example depicted in FIG. 2C, the socket interface 9 includes a threaded socket, into which the threaded anode electrode 18 of the CPT 17 is screwed. Furthermore, in the illustrative example provided in FIG. 2B, a grid electrode 19 a cathode electrode 20 and a filament electrode 21 of the CPT 17 are connected to a connector interface providing the inputs 7.

Figure 3:
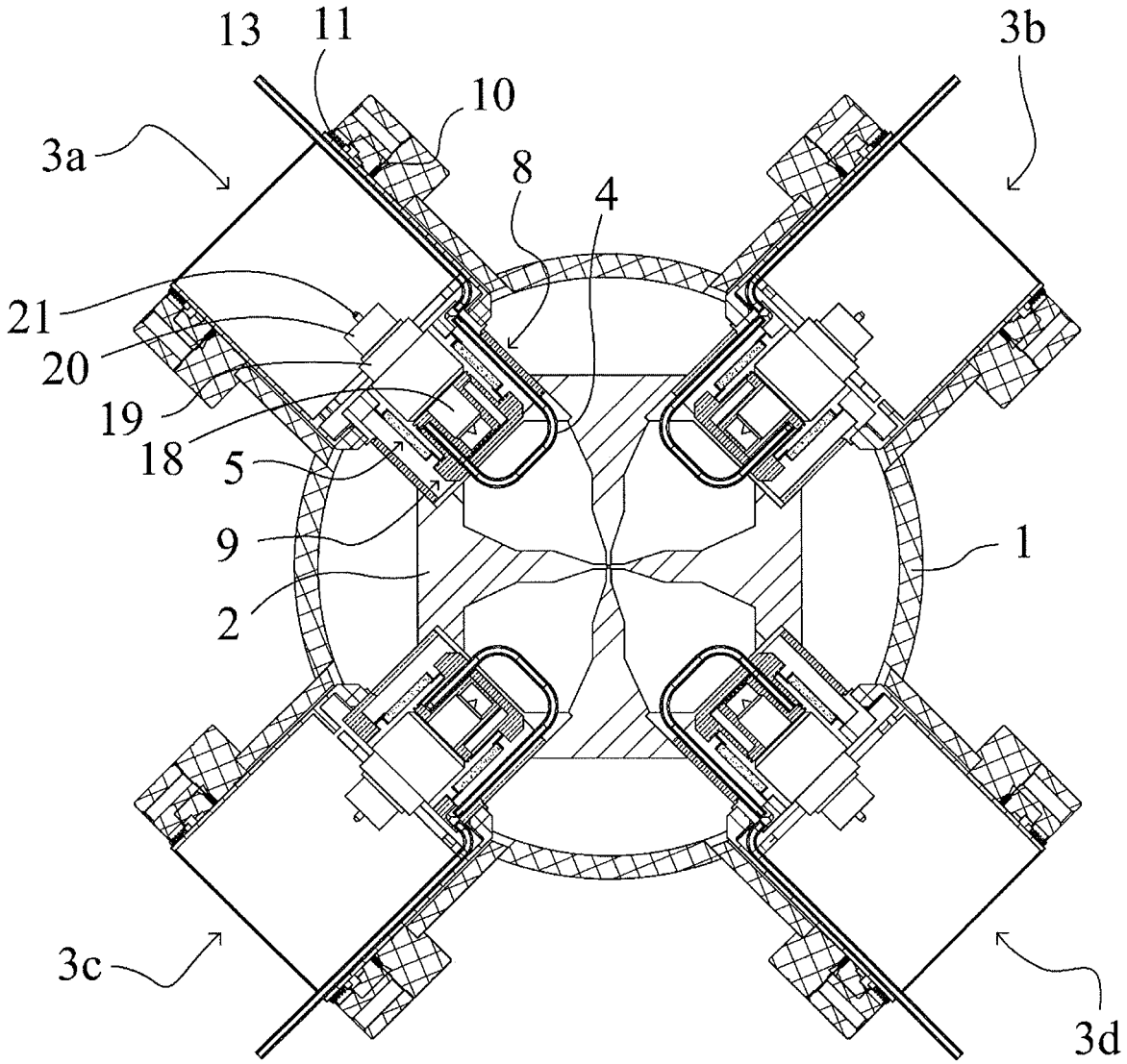
FIG. 3 depicts a cross-sectional view of the RF LINAC system including four power amplifier assemblies (depicted in FIG. 2C) attached to an RF LINAC cavity and a vacuum chamber containing the RF LINAC cavity.

Turning to FIG. 3, an illustrative example of the disclosed system/apparatus includes the integration of 4 to 12 power amplifiers onto a radiofrequency quadrupole accelerator to produce particle beams at energies in an approximate range of 2 to 5 MeV. An illustrative cross section is shown in FIG. 3 showing four power amplifier assemblies 3*a*, 3*b*, 3*c*, and 3*d* symmetrically arranged around the cavity 2. Such systems could be used for the generation of neutrons, gamma-rays and energetic ions for various scientific, medical or industrial purposes. Integrating the power amplifiers directly onto the radiofrequency quadrupole accelerator eliminates entire racks of equipment, RF power combining equipment, waveguides and power conditioning hardware. Since the RFQ cavity is a power combining cavity in its own nature, the illustratively depicted/described system/apparatus uses the power combining cavity for the dual uses of: (1) combining multiple amplifiers for use on a single LINAC system, and simultaneously (2) setting up electromagnetic fields for accelerating particles to high energies.

It can thus be seen that a new and useful system for coupling/injecting RF power into RF LINACs has been described. In view of the many possible embodiments to which the principles of this invention may be applied, it should be recognized that the examples described herein with respect to the drawing figures are meant to be illustrative only and should not be taken as limiting the scope of invention. For example, those of skill in the art will recognize that the elements of the illustrative examples depicted in functional blocks and depicted structures may be implemented in a wide variety of electronic circuitry and physical structures as would be understood by those skilled in the art. Thus, the illustrative examples can be modified in arrangement and detail without departing from the spirit of the invention. Therefore, the invention as described herein contemplates all such embodiments as may come within the scope of the following claims and equivalents thereof.

What is claimed is:

1. A system for injecting radio frequency (RF) energy into an accelerator, the system comprising:

a vacuum chamber structure containing a cavity structure providing a vacuum environment within the vacuum chamber structure;

a power amplifier assembly RF coupled to the cavity structure, wherein the power amplifier assembly comprises:

an RF power amplifier located, in operation, adjacent to the cavity structure and external to the vacuum environment, a socket interface having a complementary conductive surface for electrically coupling an RF output of the RF power amplifier, an electrically insulating break providing a high voltage hermetic break barrier between the socket interface and conductive structures within the vacuum environment of the cavity structure, and an antenna located within the cavity structure, wherein the antenna is connected to the socket interface and electromagnetically coupled to the cavity structure; and a power supply interface including:

a biasing element to bias the power amplifier assembly, and an RF power source input that receives a radio frequency energy for supplying to the power amplifier assembly for amplifying by the RF power amplifier and transmitting a resulting amplified RF power into the cavity structure, wherein the RF output of the RF power amplifier is coupled, via the socket interface and the antenna, to the cavity structure with no more than a negligible power transmission line.

2. The system of claim 1 wherein the antenna transmits the resulting amplified RF power of the RF power amplifier to the cavity structure, and wherein the antenna is a loop antenna.

3. The system of claim 1, wherein the electrically insulating break comprises a hermetic ceramic-metal seal with a sufficiently low interelectrode capacitance, and wherein the sufficiently low interelectrode capacitance is such that an inverse of the interelectrode capacitance is greater than or equal to an angular frequency of an RF input multiplied by a magnitude of the antenna impedance.

4. The system claim 3, wherein the electrically insulating break is formed by directly joining alumina with a high-conductivity metal.

5. The system of claim 1, wherein the power amplifier assembly further comprises an impedance matching circuit, and wherein the impedance matching circuit is directly coupled to the RF power amplifier and the impedance matching circuit is external to the vacuum chamber.

6. The system of claim 5, wherein the impedance matching circuit comprises an adjustable tuning element external to the vacuum chamber, and wherein the adjustable tuning element enables adjusting power supplied to the RF power amplifier.

7. The system of claim 1, wherein the RF power amplifier, when operatively installed within the system, is accessible for change out without breaking a hermetic seal of the vacuum chamber.

8. The system of claim 2, wherein the antenna and the socket interface comprise one or more cooling channels for thermal management of the system.

9. The system of claim 1, wherein the power amplifier consists of a compact planar triode (CPT).

10. The system of claim 9 wherein the CPT is operated with a cathode electrode, a filament electrode, and a grid electrode each within a voltage of −8 kV to −20 kV.

11. The system of claim 1 wherein the cavity structure is an integrated structure of the vacuum chamber.

12. The system of claim 1, wherein the power amplifier assembly contains a total of from 4 to 12 instances of the power amplifier, and wherein the 4 to 12 instances feed radio frequency energy into the cavity structure.

13. The system of claim 12, wherein the cavity structure comprises a radiofrequency quadrupole linear accelerator.

14. The system of claim 13, wherein the radiofrequency quadrupole accelerator is driven at 400-1000 MHz with 100-500 kW instantaneous power supplied by the 4 to 12 instances of the power amplifier.

15. The system of claim 1, wherein the RF power amplifier is a self-oscillating RF power source and does not require an RF power input.

16. The system of claim 1, wherein the power supply interface comprises a printed microstrip circuit.

17. The system of claim 1, wherein the power amplifier assembly is permanently sealed to the vacuum chamber.

18. The system of claim 17 wherein permanent sealing is provided in the form of a sealing operation taken from the group consisting of: welding, brazing, and epoxy gluing the power amplifier assembly to the vacuum chamber structure.

19. The system as set forth in claim 1, wherein the power supply interface includes a tunable coaxial resonator circuit.

20. A system for injecting radio frequency (RF) energy into an accelerator, the system comprising:

a vacuum chamber structure containing a cavity structure providing a vacuum environment within the vacuum chamber structure;

a power amplifier assembly RF coupled to the cavity structure, wherein the power amplifier assembly comprises:

an RF power amplifier located, in operation, adjacent to the cavity structure and external to the vacuum environment, a socket interface having a complementary conductive surface for electrically coupling an RF output of the RF power amplifier, an electrically insulating break providing a high voltage hermetic break barrier between the socket interface and conductive structures within the vacuum environment of the cavity structure, and an antenna located within the cavity structure, wherein the antenna is connected to the socket interface and electromagnetically coupled to the cavity structure; and a power supply interface including:

a biasing element to bias the power amplifier assembly, and an RF power source input that receives a radio frequency energy for supplying to the power amplifier assembly for amplifying by the RF power amplifier and transmitting a resulting amplified RF power into the cavity structure, wherein the RF output of the RF power amplifier is coupled, without an interposed tuning element, to the antenna.

21. The system of claim 20, wherein the electrically insulating break comprises a hermetic ceramic-metal seal with a sufficiently low interelectrode capacitance, and wherein the sufficiently low interelectrode capacitance is such that an inverse of the interelectrode capacitance is greater than or equal to an angular frequency of an RF input multiplied by a magnitude of the antenna impedance.

22. The system of claim 20, wherein the power amplifier assembly further comprises an impedance matching circuit, and wherein the impedance matching circuit is directly coupled to the RF power amplifier and the impedance matching circuit is external to the vacuum chamber.

23. The system of claim 22, wherein the impedance matching circuit comprises an adjustable tuning element external to the vacuum chamber, and wherein the adjustable tuning element enables adjusting power supplied to the RF power amplifier.

24. The system of claim 20, wherein the RF power amplifier is a solid state amplifier.

25. The system of claim 20, wherein the cavity structure is an integrated structure of the vacuum chamber.

* * * * *